US009795986B2

(12) United States Patent
Swoboda et al.

(10) Patent No.: US 9,795,986 B2
(45) Date of Patent: Oct. 24, 2017

(54) METHOD FOR ELECTROSTATICALLY COATING OBJECTS AND APPLICATION DEVICE

(75) Inventors: Werner Swoboda, Boeblingen (DE); Jan Reichler, Constance (DE)

(73) Assignee: EISENMANN SE, Boeblingen (DE)

( * ) Notice: Subject to any disclaimer, the term of this patent is extended or adjusted under 35 U.S.C. 154(b) by 332 days.

(21) Appl. No.: 13/880,863

(22) PCT Filed: Oct. 28, 2011

(86) PCT No.: PCT/EP2011/005472
§ 371 (c)(1),
(2), (4) Date: Apr. 22, 2013

(87) PCT Pub. No.: WO2012/062419
PCT Pub. Date: May 18, 2012

(65) Prior Publication Data

US 2013/0216725 A1 Aug. 22, 2013

(30) Foreign Application Priority Data

Nov. 12, 2010 (DE) ..... 10 2010 051 086

(51) Int. Cl.

| | |
|---|---|
| ***B05D 1/00*** | (2006.01) |
| ***B05B 5/08*** | (2006.01) |
| ***B05B 5/10*** | (2006.01) |
| ***B05B 15/12*** | (2006.01) |
| ***B05B 5/00*** | (2006.01) |

(52) U.S. Cl.
CPC ..... *B05D 1/007* (2013.01); *B05B 5/00* (2013.01); *B05B 5/087* (2013.01); *B05B 5/10* (2013.01); *B05B 15/1244* (2013.01)

(58) Field of Classification Search
None
See application file for complete search history.

(56) References Cited

U.S. PATENT DOCUMENTS 3,680,779 A * 8/1972 Reilly ..... 239/3
4,343,828 A * 8/1982 Smead et al. ..... 427/483
(Continued)

FOREIGN PATENT DOCUMENTS

DE 90 11 204 U1 10/1990
EP 1 274 515 B1 9/2006

*Primary Examiner* — Xiao Zhao
(74) *Attorney, Agent, or Firm* — Factor Intellectual Property Law Group, Ltd.

(57) ABSTRACT

An electrical field is generated between an application device and an object to be coated. At least one corona electrode associated with the application device is connected to ground, and at least one counter electrode associated with the object is connected at least at intervals to a positive potential. A system for electrostatically coating objects having an application device coating material, and an electrical field device having a high-voltage source which generates an electrical field between the application device and an object to be coated. The field device comprises at least one corona electrode associated with the application device, and at least one counter electrode associated with the object, wherein, during the operation of the device, the at least one corona electrode is connected to ground, and the at least one counter electrode is connected at least at intervals to a positive potential.

8 Claims, 3 Drawing Sheets

(56) References Cited

U.S. PATENT DOCUMENTS

| | | | | |
|---|---|---|---|---|
| 4,892,750 | A | 1/1990 | Soshi et al. | |
| 5,527,564 | A * | 6/1996 | Napadow et al. | 427/477 |
| 2002/0058105 | A1 * | 5/2002 | Louks et al. | 427/209 |
| 2009/0229517 | A1 | 9/2009 | Ko | |

* cited by examiner

METHOD FOR ELECTROSTATICALLY COATING OBJECTS AND APPLICATION DEVICE

RELATED APPLICATIONS

This application claims the filing benefit of International Patent Application No. PCT/EP2011/005472, filed Oct. 28, 2011, which claims the filing benefit of German Patent Application No. 10 2010 051 086.6 filed Nov. 12, 2010, the contents of both of which are incorporated herein by reference.

FIELD OF THE INVENTION

The invention relates to a method for electrostatically coating objects, in which an electrical field is generated between an application device and an object to be coated.

Furthermore, the invention relates to an apparatus for electrostatically coating objects, having a) an application device for coating material;

b) an electrical field device having a high-voltage source, by means of which an electrical field can be generated between the application device and an object to be coated.

BACKGROUND OF THE INVENTION

With such methods and application apparatuses known from the market, objects are provided, for example, with a paint coating.

For this purpose, the object to be coated is connected to earth potential. As an opposite pole, either a negative high-voltage potential is applied to the application device, e.g. a rotary atomiser, or an ionisation device by which paint droplets or paint particles are ionised is associated with the application device.

The paint particles thus charged are attracted by the object on account of the electrical field formed between the application device and the object, are deposited on the object and discharged in the process. However, only some of the paint emitted by the application device paints reaches the object. A partial stream of the paint, which generally contains both solids and/or binders and solvents, is not applied to the object. This partial stream is called overspray in the art.

Normally, apart from the application device, all the other components of the apparatus, such as e.g. booth walls of a painting booth, are also connected to earth potential. For this reason, all the other components of the apparatus attract paint particles, so that over time more and more overspray is deposited on these components.

Normally, attempts are made to keep the deposition of overspray on other components than the object to be coated within acceptable limits by locating components at earth potential spatially as far away from the application device and the object as possible. Alternatively, use is made of covers in the form of sheets or separating means, with which the components to be protected are coated. Overspray is also carried away from the booth and deposition on the booth walls and other components is reduced by the air management and in particular the air guidance through the booth region. However, these solutions are quite expensive.

It is an object of the invention to provide a method and an apparatus of the type mentioned at the outset, which take account of these considerations.

SUMMARY OF THE INVENTION

This object may be achieved in the case of a method of the type mentioned at the outset in that at least one corona electrode associated with the application device is connected to earth potential, and at least one counter electrode associated with the object is connected at least at times to a positive potential.

The invention is based on the finding that a directed electrostatic application of coating material can still be reliably performed even if between the application device and the object an electrical field is built up which has a field strength gradient from earth potential to a positive high-voltage potential in the direction of the application device towards the object.

The potential relationship and the direction of the electrical field are in this case still the same as in the case of known apparatuses of the type mentioned at the outset. However, the fact that the corona electrode associated with the application device is now connected to earth potential, leads to the effect that there is formed, between all the other components of the apparatus which are connected to earth potential and the counter electrode, a corresponding electrical field and the paint particles are repelled by these components. As a result, the proportion of overspray deposited on these components is effectively reduced. Furthermore, the paint particles repelled by the components of the apparatus which are connected to earth potential are directed towards the counter electrode and hence towards the object, with the result that the proportion of paint reaching and coating the object can be increased.

Accordingly, it is particularly effective when further components which may be reached by paint particles are connected to earth potential.

When an object which is electrically conductive is to be coated, the object is advantageously used as a counter electrode.

When an object which is not electrically conductive is to be coated, it is particularly favourable when an auxiliary counter electrode which is arranged on a side of the object facing away from the application device is used at least at times as a counter electrode.

In this case, it is advantageous when the object and the auxiliary counter electrode form a counter electrode system and are connected independently of one another to a high-voltage potential, the size of which is adjustable. Applied coating material, in particular paint, is mostly electrically conductive as long as it has not yet cured. With increasing layer thickness of paint on the basically non-conductive object, the electrical conductivity of the latter increases at least at the coated surface. As a result, the partially coated object may serve over time as a counter electrode, as is the case the process with an object which is electrically conductive from the beginning.

It is particularly favourable when the booth wall of a painting booth, in which the application device, the counter electrode and the object are arranged, is connected to earth potential. The painting booth can then be designed particularly compactly, so that the booth wall is only lightly coated even though it is arranged relatively close to the object compared with known apparatuses. In this case, it is favourable when a cylindrical booth wall is used.

The above-mentioned object may be achieved in the case of an apparatus of the type mentioned at the outset in that c) the field device comprises at least one corona electrode associated with the application device, and at least one counter electrode associated with the object;

d) during the operation of the device, the at least one corona electrode is connected to earth potential, and the at least one counter electrode is connected at least at times to a positive potential.

The advantages of these features and also the features explained below correspond to the advantages explained above with regard to the respective method features.

Consequently, it is particularly effective when further components of the apparatus which may be reached by paint particles are connected to earth potential.

For the coating of an electrically conductive object, the counter electrode may be advantageously formed by the object.

When an object which is not electrically conductive is to be coated, it is accordingly particularly favourable when the counter electrode is formed at least at times by an auxiliary counter electrode which is arranged on a side of the object facing away from the application device.

In this case, the object and the auxiliary counter electrode preferably form a counter electrode system and are preferably connectable independently of one another to a high-voltage potential, the size of which is adjustable.

It is favourable when the booth wall of a painting booth, in which the application device, the counter electrode and the object are arranged, is connected to earth potential.

Preferably, the booth wall is cylindrical.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention are explained in more detail below with reference to the drawings, in which.

DETAILED DESCRIPTION OF THE PRESENT INVENTION

Figure 1:
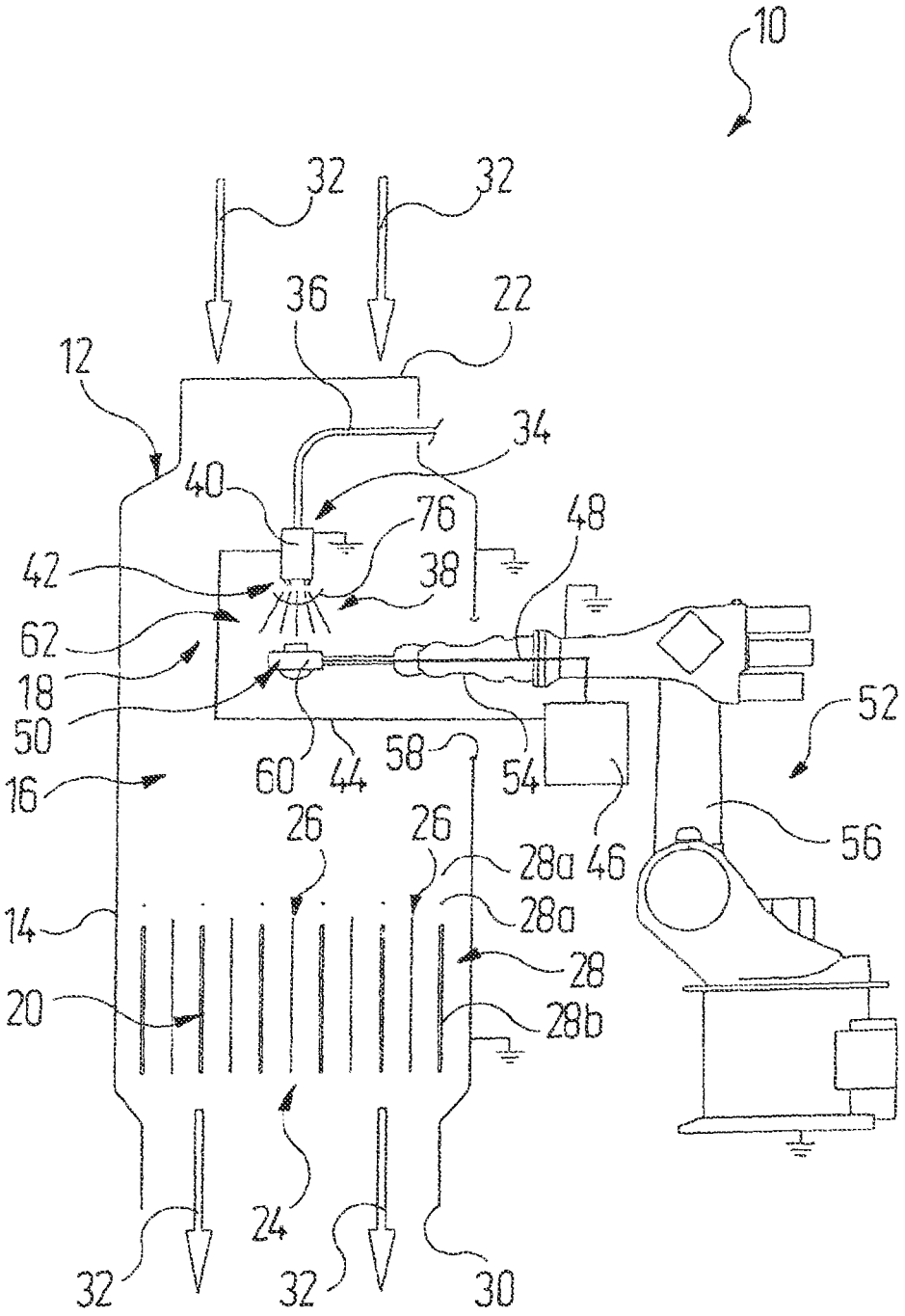
FIG. 1 shows a schematic illustration of a first exemplary embodiment of a painting apparatus having a field device.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Reference is made first of all to FIG. 1. There, 10 denotes as a whole a painting apparatus comprising a painting booth 12. The painting booth 12 delimits with a cylindrical booth wall 14 an interior space 16 which is functionally subdivided into a painting region 18 arranged at the top and a separating region 20 arranged therebelow. Via a booth ceiling 22, which is normally formed as a lower delimitation of an air supply space (not shown specifically here) with a filter ceiling, air can be supplied from above to the painting region 18 and flow through the latter downwards into the separating region 20.

Located in the separating region 20 is an electrostatically operating separating apparatus 24, which comprises a plurality of plane separating plates 26 arranged parallel to one another, of which only two bear reference symbols. Arranged between respectively two separating plates 26 is respectively one electrode unit 28 having corona wires 28*a* and a plate electrode or grid electrode 28*b*, of which only one is provided with a reference symbol. Each electrode unit 28 is connected to a pole of a high-voltage source (not shown specifically). The separating plates 24 are connected to earth potential via the other pole of the high-voltage source. Such a so-called electrical separator is known in principle from the prior art and therefore does not need further explanation.

After booth air has flown through the separating apparatus 24, it leaves the painting booth 12 via a lower booth opening 30 and can be supplied—optionally after further conditioning—to the above-mentioned air supply space again. The main flow direction of the booth air is indicated by the arrows 32.

Arranged in the painting region 18 of the painting booth 12 is an application device in the form of a stationary spray nozzle 34, which is fed with paint from a paint reservoir via a supply line 36. In the present exemplary embodiment, the spray nozzle 34 operates pneumatically and generates a downwardly directed spray jet, which is indicated schematically and bears the reference symbol 38. In a modification, it is also possible to provide application devices which work according to other operating principles. Examples which may be mentioned in this regard are so-called airless sprayers, and atomisers, such as bell atomisers and piezo atomisers, which are known per se.

The spray nozzle 34 comprises a casing sleeve 40, the longitudinal axis of which runs vertically and which is mounted so as to be displaceable in the vertical direction. The lower edge of the casing sleeve 40 bears a plurality of ionisations needles 42 which are uniformly distributed in the circumferential direction and project downwards. The casing sleeve 40 is connected to one pole of a high-voltage source 46 via a line 44 and thus connected to earth potential.

The other pole of the high-voltage source 46 is connected via a line 48 to an object 50 to be painted, which must be electrically conductive. The object 50 can be connected to a positive high-voltage potential via the high-voltage source 46.

The object 50 is moved in a defined movement sequence in the spray jet 38 of the spray nozzle 34 by means of a multiaxis application robot 52, which is known per se. The application robot 52 comprises a front free arm part 54, which carries the object 50 and is at the potential of the latter, and also a rear part 56, which is insulated therefrom and is connected to earth potential. The front free arm part 54 of the application robot 52 can be passed through an opening 58 in the booth wall 14 into the painting region 18 of the painting booth 12 and moved therein.

Besides the casing sleeve 40 having the ionisation needles 42 and the rear part 56 of the application robot 52, the cylindrical booth wall 14 is also connected to earth potential.

The above-described painting apparatus 10 can be used for painting electrically conductive objects 50 and operates as follows:

While the casing sleeve 40 of the spray nozzle 34 and hence the ionisation needles 42 are connected to earth potential, a positive high-voltage potential of about +50 kV is applied to the object 50 in the present exemplary embodiment. The size of the applied potential depends overall on several parameters, inter alia e.g. on the geometry of the object 50 or of the painting booth 12 and the type of spray nozzle 34 used.

If the ionisation needles 42 and the object 50 are now connected to the corresponding poles of the high-voltage source 46 and the latter is activated, an electrical field is formed on account of the potential difference between the ionisation needles 42 and the object 50. The object 50 thus acts as a counter electrode 60 to the ionisation needles 42. The ionisation needles 42, the counter electrode 60 and the high-voltage source 46 form as a whole an electrical field device, by which an electrical field is generated between the spray nozzle 34 and the object 50 to be coated.

The ionisation needles 42 here form corona electrodes which are associated with the spray nozzle 34 and which, on account of the potential difference present, emit electrons and act as spray electrodes. Since the ionisation needles 42 have a greater curvature at their tip compared with the object 50, the polarity of the ionisation needles 42 also governs the polarity of the corona which is formed.

The spray nozzle 34 is now activated and emits paint particles, thereby generating a paint mist comprising air and paint particles. Both the air and the paint particles are ionised at the ionisation needles 42 and on account of the electrical field present migrate to the object 50, which is thereby coated.

In FIG. 1, a curved potential line 76 is shown in the region of the spray jet 38 by way of example. A field strength of about +10 kV is present there, given the potential relationships explained.

The paint particles are repelled by the spray nozzle 34 connected to earth potential and the casing sleeve 40 having the ionisation needles 42, but also by all the other components in the painting booth 12 which are connected to earth potential. The latter components are, in particular, the above-mentioned booth wall 14 and the rear part 56 of the application robot 52.

If, therefore, paint particles reach other components in the painting booth 12 than the object 50 to be coated, and which are connected to earth potential, they are repelled by these components.

In this way, the proportion of paint particles deposited on other components than the object 50 to be coated is kept very low.

On account of the flow of the booth air from the booth ceiling 22 to the lower booth opening 30, however, a proportion of the paint particles is taken up and entrained by the booth air and flows past the object 50 without adhering to the latter. In order to free the booth air from these paint particles, the separating apparatus 24, which operates in a manner known per se, is provided.

Figure 2:
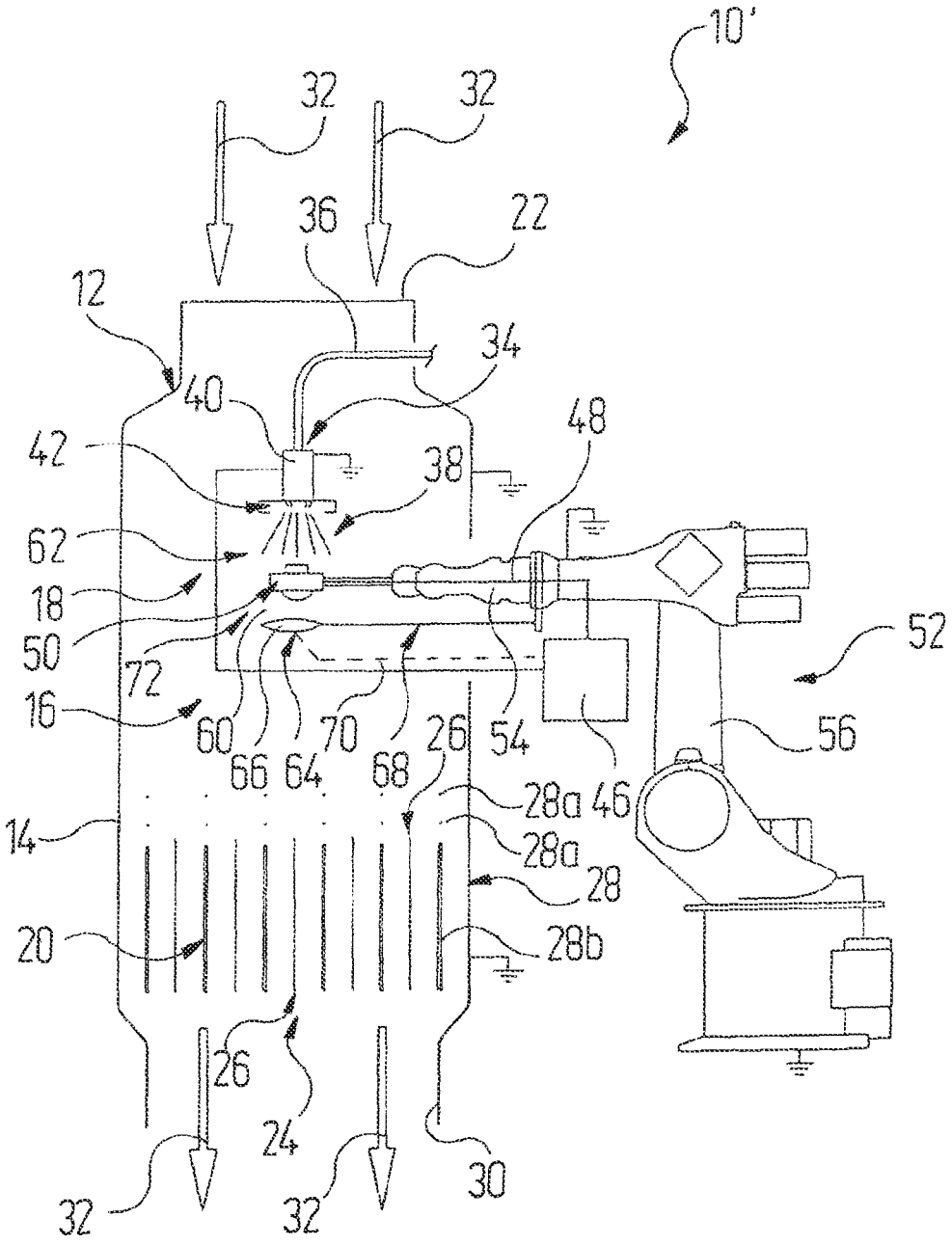
FIG. 2 shows a schematic illustration of a second exemplary embodiment of a painting apparatus having a modified field device.

In FIG. 2, a modified painting apparatus 10' is shown, as a second exemplary embodiment. In this apparatus, components corresponding to those of the painting apparatus 10 according to FIG. 1 bear the same reference symbols.

The high-voltage source 46 here is configured such that a positive high-voltage potential can be applied to the object 50, the size of which potential is adjustable.

In contrast to the painting apparatus 10 according to FIG. 1, the free front arm 54 of the application robot 52 carries an auxiliary counter electrode 64. This auxiliary counter electrode 64 has a lenticular electrode head 66 and is connected via a fastening unit 68 in such a manner to the application robot 52 that it is always located stationarily on a side of the object 50 facing away from the spray nozzle 34. Here, one of the main surfaces of the electrode head 66 faces the object 50.

A positive high-voltage potential, the size of which is adjustable, can likewise be applied to the auxiliary counter electrode 64, for which purpose it is connected correspondingly via a line 70 to the high-voltage source 46. The line 70 is indicated by a dashed line.

In the case of the painting apparatus 10', the counter electrode 60 in the form of the object 50 and the auxiliary counter electrode 64 having the electrode head 66 form a counter electrode system 72 and can be connected to a positive high-voltage potential independently of one another.

The painting apparatus 10' may also be used to paint electrically non-conductive objects 50 and operates as follows:

At the start of the painting process, initially a positive high-voltage potential is applied only to the auxiliary counter electrode 64. This potential is +50 kV in the present exemplary embodiment. Between the ionisation needles 42 and the auxiliary counter electrode 64 there forms an electrical field in which the object 50 is located. Initially, the latter has no influence on the electrical field, since it is non-conductive.

Now, the spray nozzle 34 is activated and the paint particles ionised at the ionisation needles 42 migrate in the direction of the object 50 and the second counter electrode 64. A proportion of these paint particles is deposited on the object 50 on the way to the auxiliary counter electrode 64.

Owing to the paint being electrically conductive in the uncured state, the object 50 now becomes electrically conductive at least at its surface. The contacting of the object 50 with the high-voltage source 46 is designed such that the applied paint is subjected to high voltage at a sufficient layer thickness. The thicker the paint layer on the object 50, the greater the high-voltage potential applied to it may be and the better the object 50 itself can act as a counter electrode 60.

With increasing layer thickness of the paint on the object 50, the size of the high-voltage potential at the auxiliary counter electrode 64 is reduced and is increased at the object 50 as the counter electrode until the full high-voltage potential von +50 kV is applied to the object 50 or to its coating.

In the painting apparatus 10' too, paint particles which reach other components, likewise connected to earth potential, than the object 50 to be coated are repelled by these other components and additionally directed towards the object 50, as explained above.

Figure 3:
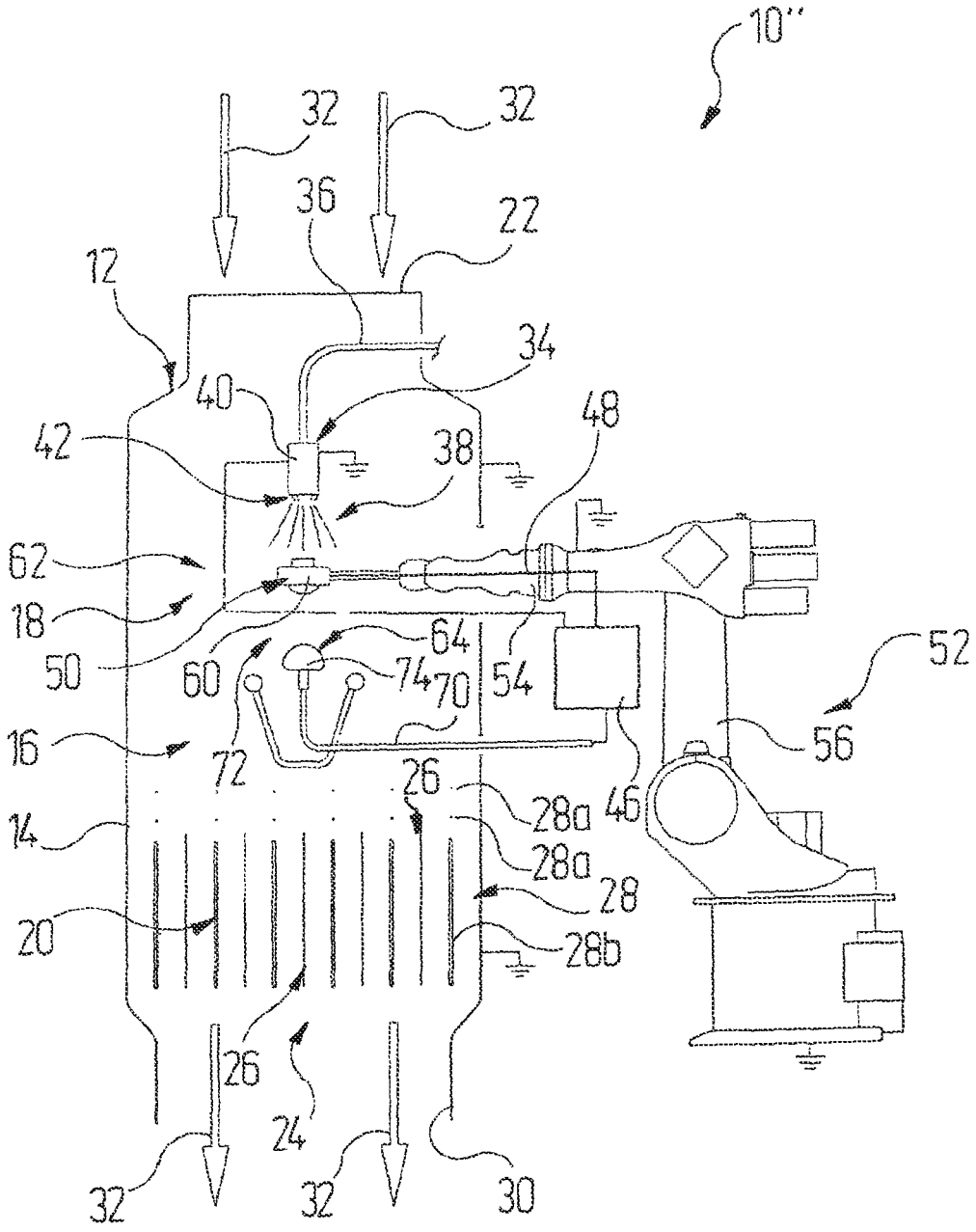
FIG. 3 shows a schematic illustration of a third exemplary embodiment of a painting apparatus having a further modified field device.

In FIG. 3, a further modified painting apparatus 10" is shown, as a third exemplary embodiment. In this apparatus, components corresponding to those of the painting apparatus 10' according to FIG. 2 bear the same reference symbols.

In the painting apparatus 10", the auxiliary counter electrode 64 is not connected to the application robot 52 but arranged stationarily in the painting region 18 and, viewed in the flow direction of the booth air, a short distance upstream of the separating region 20 of the painting booth 12.

In the painting apparatus 10", the auxiliary counter electrode 64 has a fungiform electrode head 74, which faces in the direction of the object 50. The electrode head 74 of the counter electrode 64 is connected via the line 70 to the high-voltage source 46, so that an adjustable high-voltage potential can be applied to this head too.

In the painting apparatus 10", the first counter electrode 60 in the form of the object 50 and the auxiliary counter electrode 64 with the fungiform electrode head 74 form the counter electrode system 72 and can be connected to a positive high-voltage potential independently of one another.

Fundamentally, the painting apparatus 10" operates like the painting apparatus 10', i.e. at the start of the painting process the fungiform electrode head 74 is connected to a high-voltage potential of +50 kV, which is gradually reduced in the course of the painting process, while in contrast the high-voltage potential applied to the object 50 is gradually increased depending on the erect layer thickness of the applied paint.

Of course, in the painting apparatus 10" too, paint particles which reach other components, likewise connected to earth potential, than the object 50 to be coated are repelled by these other components, as explained above.

Overall, the painting apparatuses 10, 10' and 10" can be constructed very compactly with a painting booth 12 which has smaller dimensions compared with conventional painting booths and does not have to exceed the size of the object(s) to be coated by as much.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A method for electrostatically coating objects within a painting booth, comprising the steps of:

generating an electrical field between an application device and an object to be coated, wherein for generating the electrical field at least one corona electrode associated with the application device is connected to earth potential, and at least one counter electrode associated with the object is connected to a positive potential and further wherein further components of the painting booth or further components within painting booth which may be reached by paint particles are connected to earth potential.

2. The method according to claim 1, wherein the object is used as a counter electrode.

3. The method according to claim 1, wherein an auxiliary counter electrode which is arranged on a side of the object facing away from the application device is used a counter electrode.

4. The method according to claim 3, wherein the object and the auxiliary counter electrode form a counter electrode system and are connected independently of one another to a high-voltage potential of at least 600V, a size of the high voltage potential being adjustable.

5. The method according to claim 1, wherein a booth wall of a painting booth in which the application device, the counter electrode and the object are arranged, is connected to earth potential.

6. The method according to claim 5, wherein a cylindrical booth wall is used.

7. A method for electrostatically coating objects within a painting booth, comprising the steps of:

generating an electrical field between an application device and an object to be coated, wherein for generating the electrical field at least one corona electrode associated with the application device is connected to earth potential, and further wherein further components of the painting booth or further components within painting booth which may be reached by paint particles are connected to earth potential, wherein an auxiliary counter electrode which is arranged on a side of the object facing away from the application device is used a counter electrode.

8. The method according to claim 7, wherein the object and the auxiliary counter electrode form a counter electrode system and are connected independently of one another to a high-voltage potential of at least 600V, a size of the high voltage potential being adjustable.

* * * * *